US005204530A

United States Patent [19]

Chastagner

[11] Patent Number: 5,204,530

[45] Date of Patent: Apr. 20, 1993

[54] NOISE REDUCTION IN NEGATIVE-ION QUADRUPOLE MASS SPECTROMETRY

[76] Inventor: Philippe Chastagner, 3134 Natalie Cir., Augusta, Ga. 30909-2748

[21] Appl. No.: 813,730

[22] Filed: Dec. 27, 1991

[51] Int. Cl.[5] ..... H01J 49/20

[52] U.S. Cl. ..... 250/281; 250/282; 250/294; 250/298

[58] Field of Search ..... 250/281, 282, 294, 298, 250/299, 296

[56] References Cited

U.S. PATENT DOCUMENTS

| | | | |
|---|---|---|---|
| 3,031,596 | 4/1962 | Leboutet et al. | 250/298 |
| 3,128,405 | 4/1964 | Lambertson | 250/281 |
| 3,617,739 | 11/1971 | Liebl | 250/49.5 |
| 3,641,339 | 2/1972 | McCormick | 250/41.9 |
| 3,644,731 | 2/1972 | Eloy | 250/41.9 |
| 3,679,896 | 7/1972 | Wardly | 250/41.9 |
| 3,764,803 | 10/1973 | Nakajima | 250/41.9 |
| 3,893,845 | 7/1975 | Mahaffey et al. | 71/10 R |
| 3,922,544 | 11/1975 | Maul et al. | 250/296 |
| 4,022,876 | 5/1977 | Anbar | 250/282 |
| 4,146,787 | 3/1979 | Fite | 250/305 |
| 4,163,151 | 7/1979 | Bayless et al. | 250/296 |
| 4,564,758 | 1/1986 | Slodzian et al. | 250/310 |
| 4,686,022 | 8/1987 | Rempt | 250/298 |

*Primary Examiner*—Jack I. Berman
*Assistant Examiner*—Kiet T. Nguyen
*Attorney, Agent, or Firm*—Harold M. Dixon; William R. Moser; Richard E. Constant

[57] ABSTRACT

A quadrupole mass spectrometer (QMS) system having an ion source, quadrupole mass filter, and ion collector/recorder system. A weak, transverse magnetic field and an electron collector are disposed between the quadrupole and ion collector. When operated in negative ion mode, the ion source produces a beam of primarily negatively-charged particles from a sample, including electrons as well as ions. The beam passes through the quadrupole and enters the magnetic field, where the electrons are deflected away from the beam path to the electron collector. The negative ions pass undeflected to the ion collector where they are detected and recorded as a mass spectrum.

17 Claims, 2 Drawing Sheets

NOISE REDUCTION IN NEGATIVE-ION QUADRUPOLE MASS SPECTROMETRY

The United States Government has rights in this invention pursuant to Contract No. DE-AC09-89SR18035 between the U.S. Department of Energy and Westinghouse Savannah River Company.

BACKGROUND OF THE INVENTION

1. Field of the Invention

The present invention relates to mass spectrometry. In particular, the present invention relates to noise reduction in negativeion quadrupole mass spectrometry.

2. Discussion of Background

A mass spectrometer is an analytical instrument used to determine the composition of a gas sample. The sample is ionized and the ions formed into a beam that is accelerated through a mass filter (magnetic or resonant) to separate the ions according to the ratio of their electric charge to their mass (e/m ratio). The numbers of ions of each e/m ratio is counted and recorded as a mass spectrum which will typically have peaks characteristic of the ionized species found in the sample. Gas samples or samples of volatile substances can be analyzed directly; nonvolatile solid or liquid samples must be converted to a vapor by an electric arc, laser heating, or other means.

Mass spectrometers can accurately measure even very small concentrations of ions, and thus are useful tools for chemical analysis. Specialized techniques based on mass spectrometry include secondary ion mass spectrometry (SIMS), Auger spectroscopy, electron scattering for chemical analysis (ESCA), ion probe mass spectrometry, and inductively coupled plasma (ICP) mass spectrometry. Mass spectrometers can also be used as leak detectors and residual gas analyzers.

A mass spectrometer includes three basic components: an ion source, which produces a beam of ionized particles from a sample; a means for separating different ion types in the beam by e/m ratio; and a detector, which measures and records the intensity of each of the types.

Many different ion sources are available. For example, gas samples may be ionized by an electron beam in an ionization chamber; solid or liquid samples may be vaporized by a laser beam, resulting in ejection of neutral atoms and charged particles that form a plasma; actinide samples may be obtained by using thermal ionization filaments. Recent developments include ion production by inductively coupled plasma torches, fast atom bombardment of liquid surfaces, and ionizing the surface molecules of a liquid sample with weak laser light. In a typical mass spectrometer, ions exiting the source are formed into a beam and accelerated by an eletric potential V before entering the magnetic field where they are separated according to their mass and charge. The radius of curvature of the path of an ion with mass m and charge e in a magnetic field H is $$R=(1/H)(2Vm/e)^{\frac{1}{2}}.$$

For fixed V and H, only those ions with a particular value of m/e will reach the detector. Most of the ions produced by the source have a charge of 1 electron unit, so ions of any desired mass can be collected simply by adjusting V or H. The mass spectrum is obtained by varying V or H and recording the resulting peaks. The magnetic field is provided by an electromagnet or high field strength permanent magnet.

A quadrupole mass spectrometer (QMS) can separate ions according to their m/e ratio without using a heavy permanent magnet or electromagnet. Instead, a quadrupole mass filter—an array of four straight, parallel metallic rods—is positioned so that the ion beam passes down the center of the array. Such a system is illustrated schematically in FIG. 1. QMS system 10 includes ion source 12, quadrupole mass filter 14, and ion collector/recorder 16. Quadrupole 14 has entrance plate 20 with aperture 22, and exit plate 24 with aperture 26. Four parallel metal rods 28, 30, 32, 34 extend between plates 20 and 24 as shown. Rods 28, 30, 32, and 34 have circular cross-sections. Opposing rods 28 and 30 are electrically connected by connector 36; opposing rods 32 and 34 are similarly connected by connector 38. Paired rods 28, 30 and 32, 34 are connected to opposite poles of variable DC source 40, and simultaneously to radio frequency source 42 in parallel with capacitor 44. The amplitude and frequency of RF source 42 are variable.

Incident particle beam 50 from ion source 12 enters quadrupole 14 through aperture 22. The forward motion of the ions in beam 50 is not affected by the DC field from source 40 or the RF field from source 42, since neither field has a component parallel to rods 28, 30, 32, 34. Only the lateral motion of the ions is affected by the fields.

FIG. 2 shows a cross-sectional view of quadrupole 14 through plane A of FIG. 1. Rods 28, 30, 32, 34 form square array 70 about origin 72. Each rod is a distance r (indicated by reference character 74) from origin 70. To a good approximation, the potential Φas a function of time t at a point (x,y) in plane A is $$\Phi(t)=(V_{dc}+V_0\cos\omega t)(x^2-y^2)/r^2$$

where $V_{dc}$ is the applied DC potential of source 40. $V_0$ and $\omega$ are the amplitude and frequency, respectively, of the RF potential generated by source 42. The x and y components of the lateral force F on an ion with charge e moving between the rods are $$F_x=-e(d\Phi/dx)=-(e/r^2)(V_{dc}+V_0\cos\omega t)2x$$

$$F_y=-e(d\Phi/dy)=-(e/r^2)(V_{dc}+V_0\cos\omega t)2y,$$

so the equations of motion are $$d^2x/dt^2+(2/r^2)(e/m)(V_{dc}+V_0\cos\omega t)x=0$$

$$d^2y/dt^2-(2/r^2)(e/m)(V_{dc}+V_0\cos\omega t)y=0$$

The lateral motion of the ion in plane A is therefore proportional to e/m, with a periodic component of frequency $\omega$. For fixed $V_{dc}$ and $V_0$, there is a narrow frequency range within which this motion is confined to the space between rods 28, 30, 32, 34. Resonant ions having a frequency within this range pass through array 70 without colliding with one of the rods. For fixed $V_{dc}$, $V_0$, and $\omega$, only ions with a specific e/m ratio pass through array 70. Lighter or heavier ions drift outwards and collide with one of the rods.

Resonant ions 52 pass through array 70, exiting through aperture 26 as beam 56 and passing to ion collector/recorder 16 (FIG. 1). Ion collector 16 includes a means for collecting ions such as a Faraday cage or electron multiplier, and a means for recording a mass spectrum. Nonresonant ions 54 do not reach ion collector 16. It will be understood that QMS system 10 may have different arrangements of ion source 12, quadrupole 14, and ion collector 16. For example, beam 56 may be deflected to an off-axis detector, or accelerated after passing through aperture 26 by a post-acceleration plate (not shown) located between aperture 26 and detector 16.

The ions in incident beam 50 are selected according to their e/m ratio by varying the RF frequency $\omega$ while maintaining the ratio $V_{dc}/V_0$ constant. Lighter ions (such as H, He) pass through array 70 at high frequencies, and heavier ions (such as Pb, the actinides, heavy organics) at lower frequencies. The mass spectrum of exiting beam 56 is obtained by collecting particles of different e/m ratios at ion collector 16 as the frequency is varied. Signal-to-noise ratios in the parts per billion (ppb) range can be obtained, so QMS is a sensitive technique for chemical analysis.

A common problem in QMS systems is the presence of undesired particles in the ion beam. Since ion collector 16 records the presence of a charged particle, not its sign, QMS system 10 is most sensitive when all the ions in beam 56 have the same charge. Whether QMS 10 is operated in positive or negative ion mode, the presence of oppositely-charged particles contributes to the background noise level and thereby reduces the signal-to-noise ratio and sensitivity of the system. The positive ionization mode is most commonly used. However, the negative ionization mode is theoretically superior for electro negative elements such as the halogens.

All like-charged ions can be removed from a beam by simple electrostatic techniques well known in the art, leaving a beam having only negative or only positive ions. A number of other techniques use electric or magnetic fields to further separate out the undesired components of a particle beam. Electric fields are used to select charged particles having a desired range of kinetic energies (Fite, U.S. Pat. No. 4,146,787; Wardly, U.S. Pat. No. 3,679,896); to reduce the background in ion probe mass spectrometry by deflecting low energy sputtered ions into the entrance aperture of the mass analyzer (Maul et al., U.S. Pat. No. 3,922,544; to deflect an ion beam to either a monitor or an ion collector (Nakajima, U.S. Pat. No. 3,764,803); and to remove electrons from a plasma by passage through successive electric fields of increasing amplitudes (Eloy, U.S. Pat. No. 3,644,731). Electrostatic fields are used to deflect the carrier gas ions from impinging on the beam monitor electrode in combined gas chromatography-mass spectrometry (McCormick, U.S. Pat. No. 3,641,339). Liebl (U.S. Pat. No. 3,617,739) shows an ion microprobe apparatus in which test objects can be selectively irradiated by ion beams or electron beams focused by magnetic lenses.

However, techniques such as those described above cannot readily separate electrons from other negatively-charged particles with similar kinetic energies. It is therefore especially difficult to achieve good signal-to-noise ratios when a QMS system is operated in the negative ion mode, since electrons are always produced when a negative-ion beam is formed. Furthermore, secondary ions and electrons may be generated within the system, such as when an ion strikes one of rods 28, 30, 32, 34, or when the ion beam hits a deflector, or an acceleration or post-acceleration plate (if present). These noncollimated, low-energy electrons have an essentially random energy distribution, with a maximum energy typically no more than about 70 eV of these electrons and secondary ion have sufficient energy to pass through quadrupole 14 and enter ion collector 16, adding to the background in the recorded mass spectrum. Due to their small mass (1/1837 amu), electrons with energies as low as 1 eV may pass through a quadrupole 14 without being deflected. While this problem is seen with all negative-ion beams, it is especially evident when the source of negative ions is an inductively coupled plasma (ICP) torch. The resulting high noise levels severely limit the detection limits of a QMS system.

SUMMARY OF THE INVENTION

According to its major aspects and broadly stated, the present invention is a quadrupole mass spectrometer (QMS) having an ion source, quadrupole mass filter, and ion collector/recorder system. Interposed between the quadrupole mass filter and ion collector are a magnetic field and an electron collector. When the QMS is operated in negative ion mode, the source produces a beam of ionized, primarily negatively-charged particles from a sample. The ion beam includes electrons as well as ions. The beam passes through the quadrupole and enters the magnetic field, where a majority of the electrons are deflected away from the path of the beam to the electron collector. The negative ions pass undeflected to the ion collector where they are detected and recorded as a mass spectrum.

An important feature of the present invention is the magnetic field. The magnetic field is transverse to the path of the ion beam, with field strength H high enough to deflect electrons from the beam, yet weak enough so the heavier, negative ions are essentially undeflected. The magnetic field is provided by a permanent magnet or magnets, or by an electromagnet if convenient. The field is shielded and collimated, so the operation of the quadrupole and ion collector are unaffected thereby. The magnetic field strength is within the range 1–1,000 gauss, perferably less than 100 gauss. The optimum magnetic field strength for a particular QMS system depends on the expected range of particle energies, the available distance between the quadrupole and ion collector, and such other factors as will be evident to one of ordinary skill in the art.

Another feature of the present invention is the electron collector, located between the magnetic field and the ion collector. The electron collector may be a Faraday cage surrounding the path of the ion beam, a grounded plate, or some other configuration which traps substantially all the electrons deflected from the path of the ion beam by the magnetic field.

Additional features of the present invention are the ion source, quadrupole mass filter, and ion collector of the QMS. These components are of any convenient type, positioned in any convenient spatial arrangement. Additional components such as acceleration and post acceleration plates, electrostatic lenses, and so forth may also be included. The specific locations of the magnetic field and electron collector are determined by the configuration and arrangement of these components.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
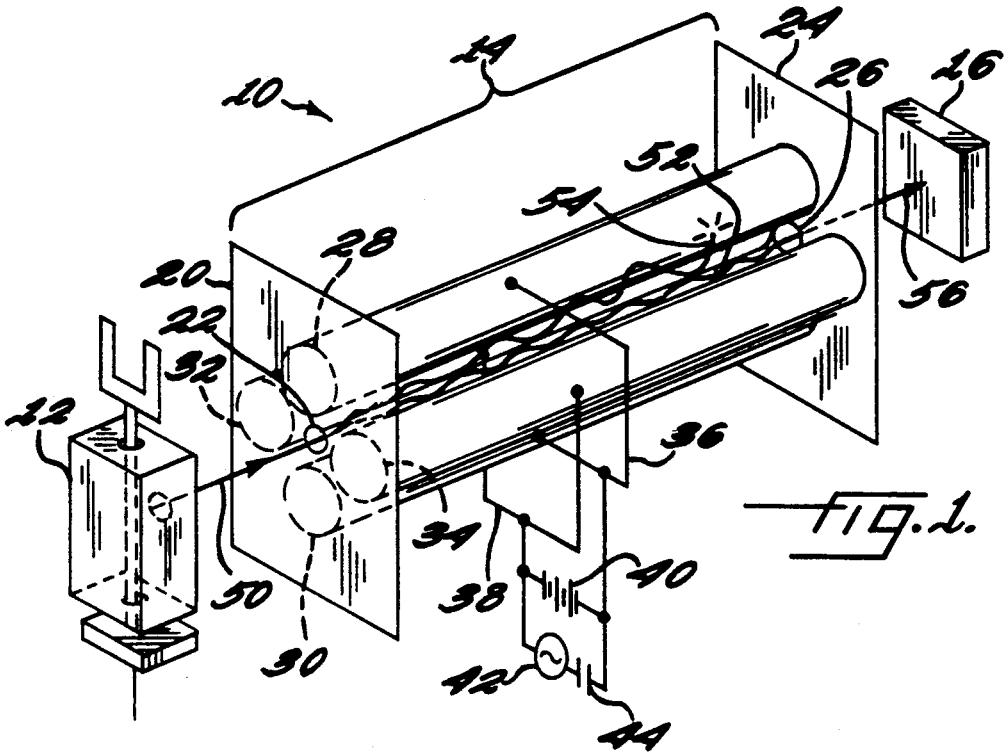
FIG. 1 is a schematic view of a quadrupole mass spectrometer system.
Figure 2:
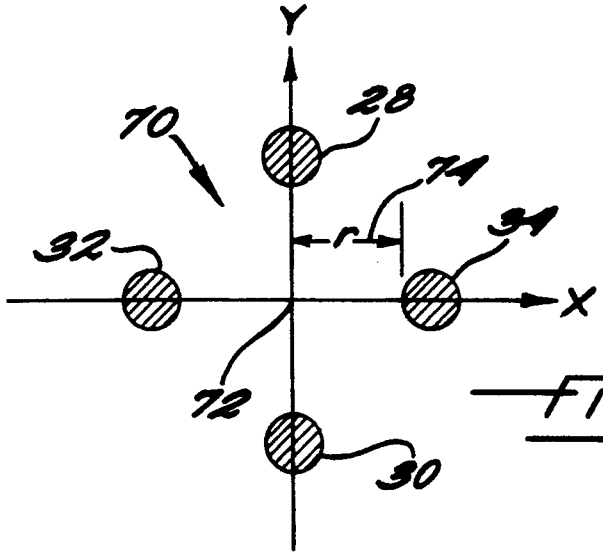
FIG. 2 is a cross-sectional view of a quadrupole mass spectrometer system through plane A of FIG. 1.
Figure 3A:
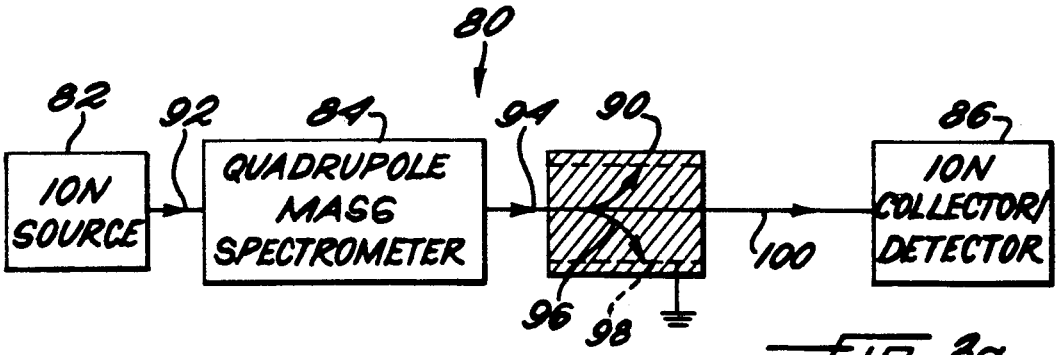
FIG. 3A is a schematic view of a low-noise negative ion quadrupole mass spectrometer according to a preferred embodiment of the present invention.

Referring now to FIG. 3A, there is shown a schematic view of an apparatus according to a preferred embodiment of the present invention. Quadrupole mass spectrometer 80 includes ion source 82, quadrupole mass filter 84 (similar to quadrupole 14 of QMS system 10 above) and ion collector/recorder system 86. Ion source 82 produces ionized particles from a sample by some convenient means. Interposed between quadrupole 84 and ion collector 86 is a magnetic field, indicated generally at 90.

When QMS 80 is operated in negative ion mode, ion source 82 produces primarily negatively-charged particles, including electrons as well as ions. These particles are formed into incident beam 92, accelerated by an electric field (not shown), and passed through quadrupole 84, emerging as beam 94. Beam 94 may include additional electrons and ions, generated by collisions between particles, collisions with the rods of quadrupole 84, and so forth. As noted above, the electrons exiting quadrupole 84 are largely uncollimated and have a random energy distribution. Beam 94 enters magnetic field 90, where electrons 96 are deflected away from the path of beam 94 to electron collector 98. Magnetic field 90 is transverse to the path of beam 94, with field strength sufficient to deflect electrons 96 from beam 94, but weak enough that the heavier negative ions 100 are undeflected. Magnetic field 90 is preferably in a plane perpendicular to that of the figure as shown. Negative ions 100 pass to ion collector 86 where they are detected and recorded as a mass spectrum.

The radius of curvature of a charged particle moving with velocity v in a magnetic field H is $$R=mv/He,$$

where m is the mass and e the charge. The kinetic energy of the charged particles in beam 94 is given by $$E=eV=mv^2/2,$$

where V the accelerating potential. Therefore, the particles have velocity $v=(2eV/m)^{\frac{1}{2}}$, so the radius of curvature of their path is $$R=(1/H)(2Vm/e)^{\frac{1}{2}}.$$

For fixed V and H, R is proportional to m/e. If V is measured in volts, H in gauss, and m in amu, then for particles of unit charge the radius in centimeters is given by $$R=(100/H)(mV/0.482)^{\frac{1}{2}}.$$

Alternatively, a given radius of curvature R is produced by a magnetic field $$H=(100/R)(mV/0.482)^{\frac{1}{2}},$$

where H is in gauss, m in amu, R in centimeters, and V in volts.

For two particles having the same charge, the radii of curvature are related according to the square of their mass:

$$R_1/R_2=(m_1/m_2)^{\frac{1}{2}}.$$

Suppose that an electron with a mass of approximately 1/1837 amu has a path with radius of curvature $R_E$. The radius of curvature $R_I$ of an ion with the same charge and mass $m_I$ is $$R_I=R_E(1{,}837x\ m_I)^{\frac{1}{2}}.$$

The ions measured by a typical QMS system have atomic weights ranging from 19 amu (fluorine) to 238 amu or higher (uranium). Ions with atomic weights as low as 10 amu can be detected. In any fixed magnetic field H, $R_I$ may therefore range from as low as $135\times R_E(m_I=10$ amu) to well over $600\times R_E(m_I=238$ amu and higher). For example, electrons moving in a path with radius of curvature $R_E=10$ cm will be deflected by over 1 cm from their original straight-line path after travelling a distance of 5 cm; while ions travelling in the same field, in a path with $R_I\geqq 1350$ cm, will be deflected by less than 0.01 cm. This effect is so large that a low, fixed magnetic field strength within the range 1–1,000 gauss (preferably less than 100 gauss) will adequately separate electrons from negatively-charged ions.

Magnetic field 90 is preferably high enough to deflect electrons 96 to collector 98, while leaving ions 100 essentially undeflected. Field 90 thus depends on the desired separation of electrons 96 from ions 100, which in turn depends on the expected range of particle masses and energies, the accelerating voltage V, the specific configuration of the quadrupole and ion collector, and such other factors as will be evident to those skilled in the art. The optimum magnetic field strength can readily be computed for any particular instrument by applying the formulas given above to these factors.

Magnetic field 90 may be provided by a permanent magnet or magnets, or by an electromagnet if convenient. Field 90 is shielded and collimated, so the operation of quadrupole 84 and ion collector 86 is unaffected thereby. Electron collector 98 may be a Faraday cage surrounding the path of beam 94, a grounded plate, or some other convenient means. Collector 98 is located between magnetic field 90 and ion collector 86. It will be understood that collector 98 may take any convenient configuration which traps substantially all the electrons deflected from the path of beam 94 by magnetic field 90. Collector 98 is grounded, that is, collector 98 is at a net positive potential with respect to beam 94.

Figure 3B:
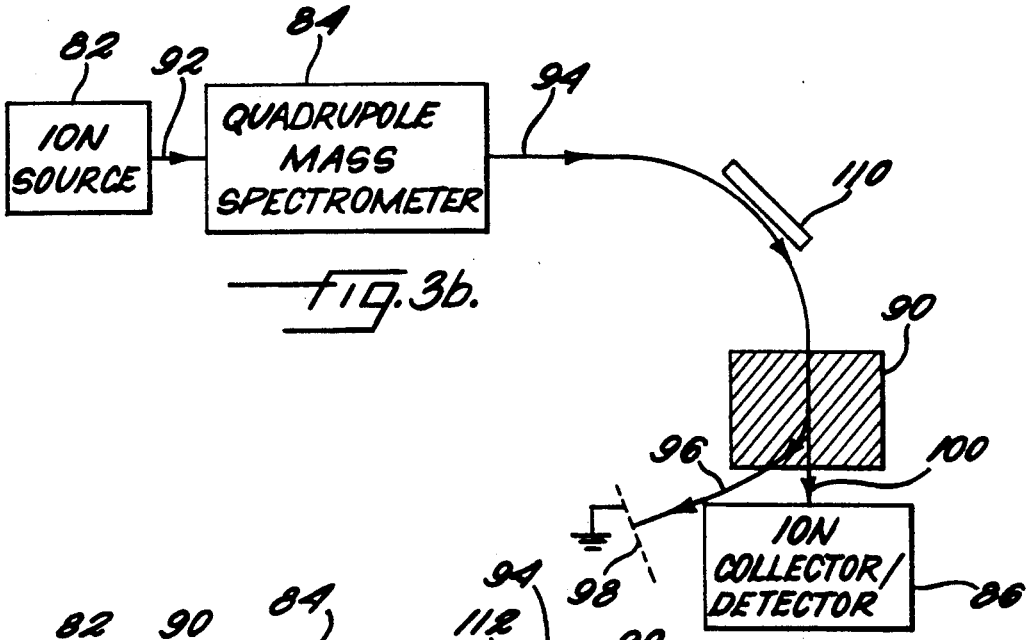
FIG. 3B is a schematic view of a low-noise negative ion quadrupole mass spectrometer according to an alternative embodiment of the present invention.
Figure 3C:
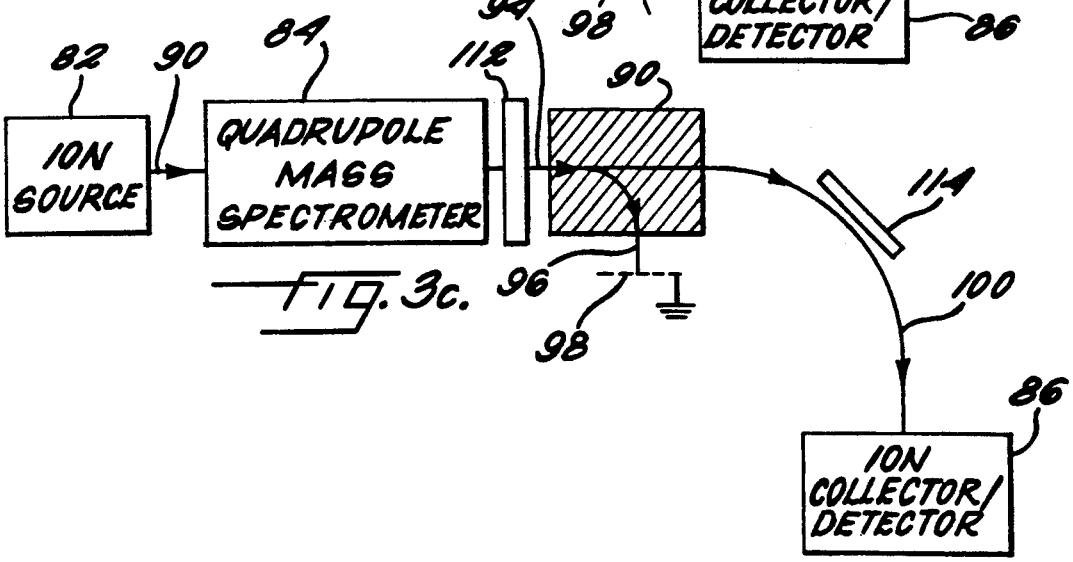
FIG. 3C is a schematic view of a low-noise negative ion quadrupole mass spectrometer according to another alternative embodiment of the present invention.

The components of QMS 80 may be positioned in any convenient spatial arrangement. Furthermore, QMS 80 may include components such as acceleration and post acceleration plates, electrostatic lenses, and so forth, in addition to those described above. Thus, a QMS system operated at net ground potential usually generates ions with relatively low energy (≦10 eV). Such a system may include post acceleration plate 110, which accelerates the ions in beam 94 so they have sufficient energy to be reliably counted by ion collector 86 (FIG. 3B). Here, magnetic field 90 is disposed between plate 110 and ion collector 86. Alternatively, when QMS 80 is operated at net high voltage (−2,000 V to −6,000 V) the ions in beam 94 have adequate energy to be counted by ion collector 86. In such a system, beam 94 may be collimated and focused by electrostatic lens 112, and directed to ion collector 86 by deflector 114. Magnetic field 90 may be located between deflector 114 and ion collector 86, or between quadrupole mass filter 84 and deflector 114 (FIG. 3C). Electron collector 98 is preferably located away from the path of beam 100. The arrangement of magnetic field 90 and electron collector 98 can readily be varied according to the specific configuration and arrangement of the components of QMS 80.

The noise level in other types of mass spectrometer may be reduced by use of an appropriately shielded and collimated magnetic field 90 and electron collector 98 of the present invention. The specific configuration of the mass spectrometer would dictate the arrangement of the individual components, shielding to prevent interference with the operation of the system, and so forth. For example, some mass spectrometers use a quadrupole as a retarding filter to remove low-energy ions from the ion beam: the beam is decelerated and passed through a DC quadrupole, then reaccelerated and directed to an ion collector. Some of the electrons and secondary ions generated within the quadrupole (or elsewhere in the system) have enough energy to reach the ion collector. There, they are counted and add to the background in the recorded mass spectrum. A magnetic field and electron collector according to the present invention would largely eliminate these extraneous signals, increasing the sensitivity of such a system.

It will be apparent to those skilled in the art that many changes and substitutions can be made to the preferred embodiment herein described without departing from the spirit and scope of the present invention as defined by the appended claims.

What is claimed is:

1. A mass spectrometer for isotopic analysis of a sample, said spectrometer comprising:

means for ionizing said sample to produce an ion beam, said beam containing electrons having a random energy distribution;

means for directing said beam along a path;

means for deflecting said electrons away from said path, whereby said electrons are substantially removed from said beam; and first means for collecting said ions.

2. The mass spectrometer as recited in claim 1, wherein said deflecting means further comprises means for producing a magnetic field, said producing means oriented with respect to said path so that said magnetic field deflects said electrons away from said path.

3. The mass spectrometer as recited in claim 1, wherein said deflecting means further comprises means for producing a magnetic field, said producing means oriented with respect to said path so that said magnetic field deflects said electrons away from said path, and wherein said beam further comprise negative ions and said magnetic field has a field strength sufficient to deflect said electrons from said path but insufficient to deflect substantially said ions from said path.

4. The mass spectrometer as recited in claim 1, wherein said deflecting means further comprises means for producing a magnetic field, said producing means oriented with respect to said path so that said magnetic field deflects said electrons away from said path, said magnetic field having a field strength not exceeding 1000 gauss.

5. The mass spectrometer as recited in claim 1, further comprising second means for collecting said electrons, said second collecting means positioned to receive said deflected electrons.

6. The mass spectrometer as recited in claim 1, further comprising second means for collecting said electrons, said second collecting means positioned to receive said deflected electrons, said second collecting means having an electrical potential that is positive with respect to said electrons.

7. The mass spectrometer as recited in claim 1, wherein said first collecting means includes means for counting said ions.

8. A mass spectrometer, for isotopic analysis of a sample, said spectrometer comprising:

means for ionizing said sample so that a beam containing ions and electrons is produced, said electrons having a random energy distribution, and at least some of said ions being negative ions;

means for directing said beam along a path;

means for generating a magnetic field, said field having sufficient field strength to deflect said electrons away from said path but not said negative ions;

first means for collecting said ions, said first collecting means positioned in said path; and means for counting said ions, said counting means in operating connection with said first collecting means.

9. The mass spectrometer as recited in claim 8, further comprising second means for collecting said electrons, said second collecting means positioned away from said path.

10. The mass spectrometer as recited in claim 8, further comprising second means for collecting said electrons, said second collecting means positioned away from said path, and wherein said electron-collecting means has a positive electrical potential with respect to said electrons.

11. The apparatus as recited in claim 8, wherein said magnetic field has a field strength not exceeding 1000 gauss.

12. The apparatus as recited in claim 8, wherein said magnetic field has a field strength of at least 10 gauss but not more than 1000 gauss.

13. A method for reducing background noise in quadrupole mass spectrometric measurements of samples that produce a beam of negative ions, said beam containing electrons having a random energy distribution, said method comprising the step of deflecting said electrons away from said path, whereby said electrons are substantially removed from said beam.

14. The method as recited in claim 13, wherein said deflecting step further comprises the steps of:

creating a magnetic field in the path of said beam, said magnetic field having a field strength sufficient to deflect said electrons but insufficient to deflect substantially said negative ions; and collecting said deflected electrons.

15. The method as recited in claim 13, wherein said deflecting step further comprises the steps of:

creating a magnetic field in the path of said beam, said magnetic field having a field strength of at least 10 gauss but not more than 1000 gauss; and collecting said deflected electrons.

16. The method as recited in claim 13, wherein said deflecting step further comprises the steps of:

creating a magnetic field in the path of said beam, said magnetic field having a field strength sufficient to deflect said electrons but insufficient to deflect substantially said negative ions; and collecting said deflected electrons on a plate having a positive electrical potential with respect to said electrons.

17. The method as recited in claim 13, wherein said deflecting step further comprises the steps of:

creating a magnetic field in the path of said beam, said magnetic field having a field strength of at least 10 gauss but not more than 1000 gauss; and collecting said deflected electrons on a plate having a positive electrical potential with respect to said electrons.

* * * * *